US005352086A

United States Patent [19]

Mank

[11] Patent Number: 5,352,086

[45] Date of Patent: Oct. 4, 1994

[54] APPARATUS FOR LIFTING SHEETS FROM A STACK

[75] Inventor: Klaus Mank, München, Fed. Rep. of Germany

[73] Assignee: Georg Speiss GmbH, Gersthofen, Fed. Rep. of Germany

[21] Appl. No.: 932,990

[22] Filed: Aug. 20, 1992

Related U.S. Application Data

[63] Continuation-in-part of Ser. No. 629,652, Dec. 7, 1990, abandoned.

[30] Foreign Application Priority Data

Jan. 27, 1990 [DE] Fed. Rep. of Germany ..... 4002368

[51] Int. Cl.[5] ..... B65G 59/04

[52] U.S. Cl. ..... 414/797; 271/95; 271/91; 294/64.1

[58] Field of Search ..... 271/90, 91, 102, 103, 271/107, 95; 294/64.1, 65; 414/793, 797, 796.9, 627, 737, 752

[56] References Cited

U.S. PATENT DOCUMENTS

| | | | |
|---|---|---|---|
| 2,766,879 | 10/1956 | Draper | 209/512 |
| 3,048,391 | 8/1962 | Spiess | 271/90 |
| 4,486,013 | 12/1984 | Vander Syde | 271/107 |
| 4,723,353 | 2/1988 | Monforte | 29/568 |

FOREIGN PATENT DOCUMENTS

| | | | |
|---|---|---|---|
| 928562 | 12/1947 | France | 271/107 |
| 504139 | 4/1939 | United Kingdom | 271/107 |
| 760891 | 11/1956 | United Kingdom | 271/107 |

*Primary Examiner*—Michael S. Huppert
*Assistant Examiner*—Janice Krizek
*Attorney, Agent, or Firm*—Harrison & Egbert

[57] ABSTRACT

An apparatus for lifting a sheet from a stack of sheets including a frame, a suction plate for engaging a sheet from the stack, a lifter connected to the suction plate so as to move the suction plate in a vertical direction, a setting member pivotally connected to the suction plate, and a ramp member connected to the frame and positioned along a length of the setting member. The lifter serves to move the suction plate between a first sheet-engaging position and a second sheet-releasing position. The suction plate is pivotally connected to the lifter so as to align parallel to the surface of a sheet. The setting member extends upwardly from the suction plate The ramp member is in cooperative relationship with the setting member. The setting member causes the ramp member to be positioned in parallel relationship to the suction plate when the suction plate is in the first position. The ramp member is stationary during a movement of the suction plate between the first and second positions. The suction plate includes a plate carrier and a setting member pivotally affixed to a surface of the plate carrier. The setting member extends through an opening in the ramp member. An abutment member is affixed to the setting member so as to be interactive with the ramp member.

17 Claims, 4 Drawing Sheets

APPARATUS FOR LIFTING SHEETS FROM A STACK

RELATED APPLICATIONS

The present application is a continuation-in-part of U.S. patent application Ser. No. 07/629,652, filed on Dec. 7, 1990, and entitled "Apparatus for Lifting Sheets From a Stack", now abandoned.

TECHNICAL FIELD

The present invention relates to an apparatus for lifting sheets from a stack of sheets. More particularly, the present invention relates to sheet feed devices having suction heads fitted with separating and dragging suckers.

BACKGROUND ART

When sheet-like printed materials are separated, there is frequently the problem that the surface of the stack does not form a plane, but is inclined in one or more directions. The size and direction of the inclination can be due to the wariness of the paper. This can also be caused by the presence of inked areas which are irregular in their distribution. In conventional equipment, it is possible for the suction plates to be set parallel by inclining or, respectively, twisting the entire sucker parallel to the surface of the stack. The suckers, set in this manner, are then locked in position after the setting operation. This is carried out so that the setting which has been made is retained during the entire stroke. In this arrangement, the sucker is not able to be altered during the operation. Therefore, it is not possible to adapt the inclination of the suction plate to any changes in the inclination of the stack surface during the operation of the sheet lifting device. In conventional equipment, adjustment is only possible so as to take care of relatively small inclinations of the suction plates. In many cases, there is no possibility of an exact adjustment to the surface of the stack of sheets. Whenever there is a considerable inclination in the stack of sheets, the suction plates may be inappropriate for use during the sheet lifting operations.

Attempts have been made, in the past, to use rubber bands which are slipped over the suction plates so as to achieve an elastic adaptation to the surface of the stack. In this arrangement, there is the disadvantage that the alignment of the suction surface is performed by the action of a force on the surface of the stack. This may mean that two or more sheets are aspirated simultaneously. When this occurs, there is likely to be a stoppage of production.

It is an object of the present invention to provide an apparatus for lifting sheets in which the suction plates are aligned in relation to the stack surface during each lifting stroke without forces acting on the surface of the stack.

This and other objects and advantages of the present invention will become apparent from a reading of the attached specification and appended claims.

SUMMARY OF THE INVENTION

In order to achieve these advantages, the present invention employs the use of suction plate carriers which are able to pivot during operation. These suction plate carriers are able to be set by a plurality of setting members. In the lower part of the stroke, the setting members cooperate with a ramp member. During this operation, the ramp member is stationary relative to the stroke and is able to be set parallel to the surface of the stack.

The operation of the present invention means that the difficulties and disadvantages of conventional equipment are remedied. In the present invention, the ramp member, which is stationary in the stroke or lifting direction, creates the advantage that it is possible to perform adjustment during operation so that continuous adjustments of inclination are possible in accordance with changing conditions during operation. The alignment of the suction plates parallel to the surface of the stack may be readily performed before the suction plates strike the surface of the stack. As a result, practically no setting forces act on the surface of the stack. This ensures reliable operation which permits a gentle handling of the sheets. The objects of the present invention are obtained with relatively simple and economic techniques.

In the preferred embodiment of the present invention, the setting members cooperate with a resetting member arranged generally at the top of a supporting frame. This resetting member is spaced from a ramp member. The resetting member assures that the initial position of the suction plates may be predetermined. This initial position is reset during each stroke of the sucker. Since each of the separating suckers return to their initial position during each suction stroke, it is possible to ensure that the suckers are aligned in this position when the sheet is released from the suckers and is transferred to the drag sucker. This overcomes the difficulties associated with conventional equipment in which the inclination of the suction plate is maintained during the transfer of the sheet to the drag suckers. Whenever the separating suckers deviate from the normally horizontal alignment, greater difficulty and unreliability occurs during the transfer of the sheet to the drag suckers. The present invention, by assuring horizontal alignment of the separating suckers, assures reliable operation during the transfer of the sheets from the separating suckers to the drag suckers.

The present invention also makes it possible for the suction plate carrier to be cushioned on the ramp member at the bottom part of its stroke. The present invention utilizes an elastic connection, by using springs, which is suitable for allowing different separating strokes. The use of the elastic connection serves to avoid a jerky operation of the suckers. Additionally, the elastic connection also assures that the suction plate carriers are cushioned in the upper end part of the suction stroke.

The present invention utilizes a ramp member which is able to be maintained in a setting parallel to the surface of the stack. The ramp member is mounted on the suction head frame with the same degrees of freedom as the suction plate carrier. This arrangement ensures simple and convenient manipulation and provides a high degree of reliability. The ramp member includes a suitable releasable locking mechanism for use whenever the ramp member must be manipulated by hand.

The ramp member is in the form of a ramp disk which is coaxial to the axis of the sucker. This disk is spaced from the resetting member by a pin which extends from the resetting member. The pin includes a bearing member which is in the form of a ball head.

The resetting member of the present invention is a stationarily mounted plate which is secured to the suction head frame. This plate is horizontally aligned so that there is an automatic reset of the separating suckers in a direction parallel to the setting of the drag suckers. The use of this stationary horizontal arrangement of the resetting member causes the separating suckers to be positioned in a position generally parallel thereto.

The present invention utilizes setting bars which engage the suction plate carrier and extend through the resetting member. These setting bars also extend through openings in the ramp member. These openings in the ramp member have greater diameters at the surfaces of the ramp member so as to allow for play in the motion of the ramp member relative to the setting bars. At least one resiliently mounted abutment member is positioned on the setting bars so as to be brought into and out of engagement with the ramp member. As such, the movement of the setting members to the first sheet-engaging position will cause the abutment member to act on the ramp member so as to place the ramp member in a position parallel to the suction plate carrier. The resiliently mounted abutment element also provides the advantage of the resilient mounting of the suction plates in the setting members. The setting bars are pivotted on the plate carrier with at least the same degree of freedom as the plate carrier is pivotted on the lifting member. This serves to avoid a forceful operation and further assures the reliability of the operation of the present invention.

In an alternative embodiment of the present invention, the setting members may be in the form of pretensioned springs which are pivotally connected with the suction plate carriers and the resetting member. The tension springs carry an abutment member which is able to be brought into and out of engagement with the ramp member. The tension springs provide a resilient support of the plate carrier on the associated ramp member. They also function as setting members which are responsible for a resetting effect because of the automatically- produced equilibrium.

In the present invention, the setting members are in the form of setting bars which are pivotted on the suction plate carriers and are parallel to the axis of the suction plate. A pretensioned spring is arranged on each of the setting bars. In turn, the abutment element, associated with the ramp member, is resiliently supported on the setting bars. This allows for the creation of a very sturdy structure since the setting bars allow relatively large forces to be transmitted in either direction. The use of the setting bars assures a precise guiding action and generally high reliability to the apparatus of the present invention.

The present invention utilizes two respective abutment elements which accept a pretensioned compression spring therebetween. Each of these abutment elements are able to be moved toward each other. These abutment elements are associated with the ramp member and with the resetting member. These abutment members assure that there is a resilient supporting action on the setting bars. This provides resilience support for the plate carrier, for the ramp, and for the resetting member.

The plate carrier is mounted on a ball joint with the lifter. A plurality of setting members, preferably three (3) setting members, are arranged with equal spacing around the circumference of the suction plate carrier. This arrangement assures that the arrangement is statically defined. The plate carrier may also be mounted on a hinge joint so as to allow for the use of two setting members which are arranged opposite to each other with respect to the pivot axis.

Further advantageous features of the invention and convenient developments thereof will be gathered from the ensuing account of the preferred embodiments of the present invention and from the claims.

DETAILED DESCRIPTION OF THE INVENTION

Figure 1:
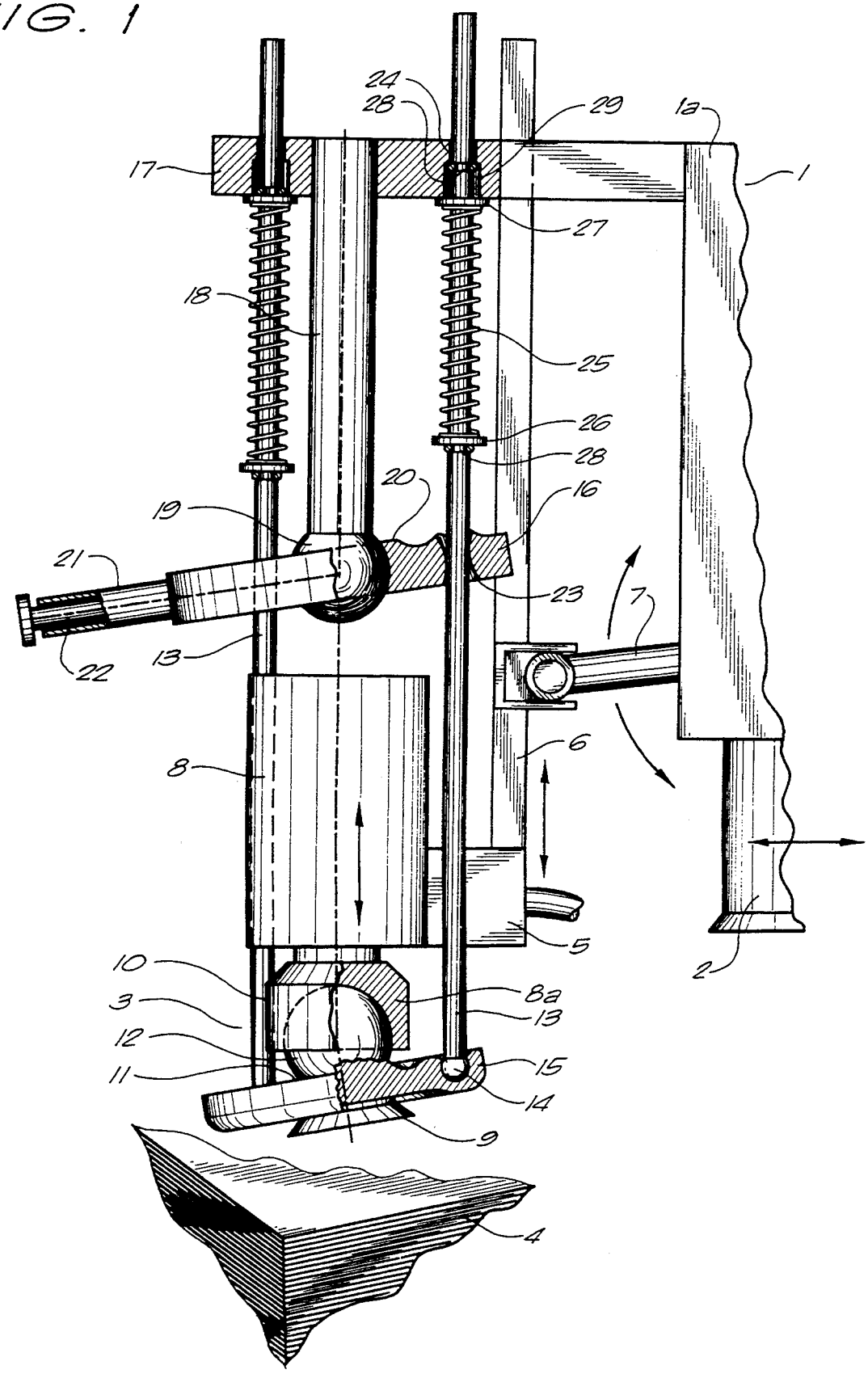
FIG. 1 is a side elevational view of a suction head in accordance with the present invention, provided with a separating sucker operated by setting bars, as part of a sheet delivery system, shown partly in section.

Referring to FIG. 1, there is shown at 1 the apparatus for lifting sheets from a stack in accordance with the preferred embodiment of the present invention. Since the basic structure and basic workings of a sheet delivery system are well known in the art, the present invention is limited to the features illustrated herein for the purposes of separating and lifting sheets from a stack.

The apparatus 1, as shown in FIG. 1, has a suction head frame la which is provided with dragging suckers 2 and with separating suckers 3. The dragging suckers 2 are able to move as indicated by the arrow in the horizontal direction. The separating suckers 3 are able to be moved upwardly and downwardly in the vertical direction. Specifically, the separating suckers 3 can move from a first position in which the separating sucker engages the uppermost sheet of a stack 4 so as to lift the sheet from the stack 4 and to transfer the sheet to drag sucker 2. When the sheet is transferred to the drag sucker 2, the sheet is released from the separating sucker 3. In general, the separating sucker 3 is arranged in a row parallel to the rear edge of the stack 4. The separating sucker 3 is mounted on a cross member 5. Cross member 5 is designed in the form of a suction duct. The cross member 5 is provided with guide bars 6 which extend vertically upwardly into vertical guide recesses of the suction head frame la. The guide bars 6 are able to be mechanically moved upwardly and downwardly by a pivotting arm 7. The pivotting arm 7 is moved in accordance with a vertical stroke as indicated by the arrows associated therewith in FIG. 1.

In the illustrated working embodiment of FIG. 1, the separating sucker 3 is provided with a lifting mechanism. This lifting mechanism is a piston-and-cylinder unit 8 mounted on the cross member 5. The piston 8*a* is able to be moved upwardly and downwardly by the action of vacuum. This action is in addition to the mechanical stroke, described herein previously. The interaction of the mechanical driving system, represented by the pivotting arm 7, and the pneumatically powered stroke allows the suction plate 9 of the separating sucker 3 to move toward the uppermost sheet of the stack 4 so as to be landed on the top side of stack 4.

The piston 8*a* of the piston-and-cylinder unit 8 is provided with a partially spherical cap 10. The suction plate 9 is mounted on a plate carrier 11. Plate carrier 11 is provided with a ball which fits into the associated partially spherical cap 10. This pivotal articulated relationship between the suction plate and the lifting mechanism ensures that it is possible to set the suction plate so that its lower suction surface is parallel to the top side of the stack 4. This parallel relationship is maintained even when the stack 4 is inclined to one side or, as illustrated in FIG. 1, is inclined toward two sides. The lower suction surface of the drag sucker 2 has a horizontal alignment. On the transfer of the sheets from the stack 4 to the drag sucker 2, the suction surface of the separating sucker 3 is in a horizontal position. This operation is described in conjunction with FIGS. 2 and 3 herein. The suction plate 9 of the separating sucker 3 is controlled so that the suction surfaces are horizontal on reaching the top end of the suction stroke. It is also controlled such that the suction plate 9 is parallel to the top side of stack 4 upon reaching the lower end of the suction stroke.

In order to implement the sheet lifting apparatus 1 of FIG. 1, a plurality of setting bars 13 are provided. Preferably, a total of three setting bars are provided so as to extend around the plate carrier 11 in equally spaced relation. The setting bars 13 function as setting members and are arranged parallel to the axis of the sucker. When three setting bars are utilized, there should be an equal spacing of 120 degrees between them. Each of the setting members 13 are pivotally mounted by means of the ball joints 14 on a peripheral flange 15 on the respective plate carrier 11. In general, the pivotal connection between the setting bars 13 and the plate carrier 11 should provide a similar degree of freedom as the pivotal connection between the plate carrier 11 and the lifting mechanism 8. The setting bars 13, as received by the suction plate carriers 11, cooperate with a ramp disk or member 16 which is coaxial to the axis of the sucker 9. The setting bars 13 also cooperate with a reset member 17 which is fixed so as to be horizontal and is secured to the suction head frame 1. The ramp member 16 is interposed between the reset member 17 and the plate carrier 11. Specifically, the reset member 17 is a plate which is secured by fixed arms on the suction head frame 1. From the stationary resetting plate 17, there extends downwardly a pin 18 which is coaxial to the suction plate 9. The lower end of pin 18 has a bearing member which is in the form of a ball 19. The ramp member 16 includes a partially spherical receptacle 20 mounted on the ball 19. This mounting of the cap 20 on ball 19 provides an articulated connection between the ramp member 16 and the pin 18. This enables the ramp member 16 to be mounted so as to pivot in all directions. The ball 19 is held by pin 18 above the piston-and-cylinder unit 8.

The ramp member 16, which is borne by a ball joint, is pivotted with respect to the suction head frame la in the same manner as the associated plate carrier 11 on the lifting member 8. In this manner, the ramp disk 16 is able to be set in the same manner parallel to the top surface of the stack as is the suction surface of the associated suction plate 9. As such, the operation of the ramp disk is practically a duplication of the operation of the plate carrier 11 relative to the top of the stack 4.

As can be seen, the ramp member 16 is provided with a laterally projecting actuating arm 21. Actuating arm 21 can have a handle for manual operation of the ramp disk 16. So as to prevent unintended refitting of the ramp disk 16, the disk may be simply adjusted so as to be fixedly mounted on the ball 19. So as to achieve this, there is a detachable locking mechanism in the form of a locking screw 22, which extends through the actuating arm 21 and which is able to be brought into engagement with the surface of ball 19. The locking screw 22 may be slackened so as to reset the Ramp disk 16. Since the ramp disk does not move vertically, it is possible to reset the ramp disk during operation. In substitute of the manual adjustment provided for in this case, it is also possible to have a continuous position correction system for the ramp disk 16 powered by a motor.

The ramp disk 16 is provided with a plurality of openings 23 associated with the setting bars 13. The openings 23 are configured so as to allow suitable play and movement between the ramp disk 16 and the setting bars 13. The openings 23 are, in this respect, made suitably oversize in diameter relative to the size of the setting bar 13 such that the pivotting motion of the ramp disk 16 is not impeded by the setting bar 13 extending through the openings 23. Specifically, as illustrated in FIG. 1, the openings of the ramp disk 16 on the surfaces of the ramp disk have a greater diameter than the diameter of the center of the openings 23. The openings 23 assume a somewhat hourglass shape. This configuration provides the necessary freedom for pivotting.

The upper ends of the setting bars 13 extend through openings in the resetting plate 17. These openings may be in the form of guide holes 24. The setting bars extend through guide holes 24 with suitable room for sliding play. A pretensioned compression spring 25 is mounted on the setting bars between the ramp disk 16 and the resetting plate 17. The pretensioned compression spring 25 is mounted between two spring plates 26 and 27. The spring plates are held in place so as to resist the resilient force of the spring 25. Clamping rings 28 interlock with spring plates 26 and 27 so as to provide the necessary resistance. The spring plates 26 and 27 form abutment members which abut against the ramp disk 16 and the resetting plate 17. The distance between the spring plates 26 and 27 is such that the lower spring plate 26 only comes into engagement with the ramp disk 16 at the lower end of the suction stroke. As such, and as will be described hereinafter, the spring plate 26 will engage and abut the ramp disk 16 when the suction plate 9 is in its sheet-engaging position. The spring plate 27 will only abut the reset member 17 when the suction plate 9 is in its sheet-releasing position. The resilient forces provided by spring 25 are suitably transferred to the setting bar 13 so as to cause a pivotal motion of the pivotally connected plate carrier 11.

Figure 2:
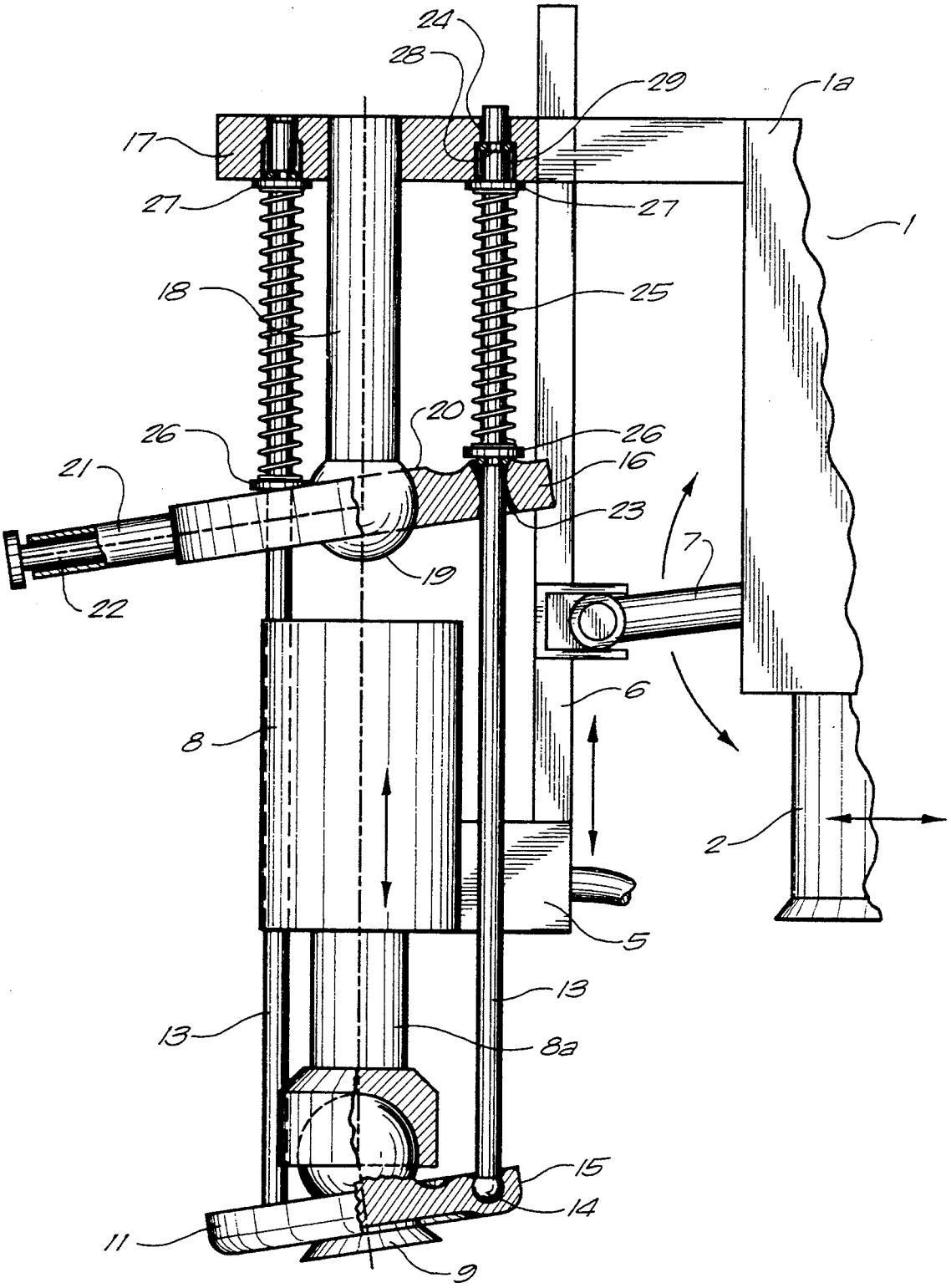
FIG. 2 shows the operation of the present invention in its first sheet-engaging position.

Referring to FIG. 2, it can be seen how the operation of the ramp disk 16 assists in the lifting of a sheet from a stack. In FIG. 2, it can be seen that the suction plate 9 is in its lowermost sheet-engaging position. As can be seen, the piston 8a is fully extended downwardly in this position, the lower spring plates 26 of the setting bars 13 extend downwardly so as to engage a surface of the ramp disk 16. It can also be seen that the plate carrier 11 is inclined so as to be parallel to the inclination of stack 4. One end of the plate carrier 11 is lower than another end of the plate carrier 11. The lowermost end of the plate carrier 11 will move the corresponding setting bar 13 downwardly. The lowermost portion of the plate carrier 11 will cause a corresponding movement of the spring plate 26 so as to engage a surface of the ramp disk 16. The ramp disk 16 pivots downwardly with respect to the ball 9 of pin 18. Similarly, the raised portion of the plate carrier 11 will cause its associated spring plate 26 to offer less resistance to the upward movement of the ramp disk 16 thereabout. In essence, in this arrangement, the setting bars, and their associated abutment elements 26 do not move simultaneously. These bars move with a time lag dependent upon the angle of inclination of the stack 4. In this arrangement, the plate carrier 11 is accordingly set parallel to the associated surface formed by the top side of the ramp disk 16.

Figure 3:
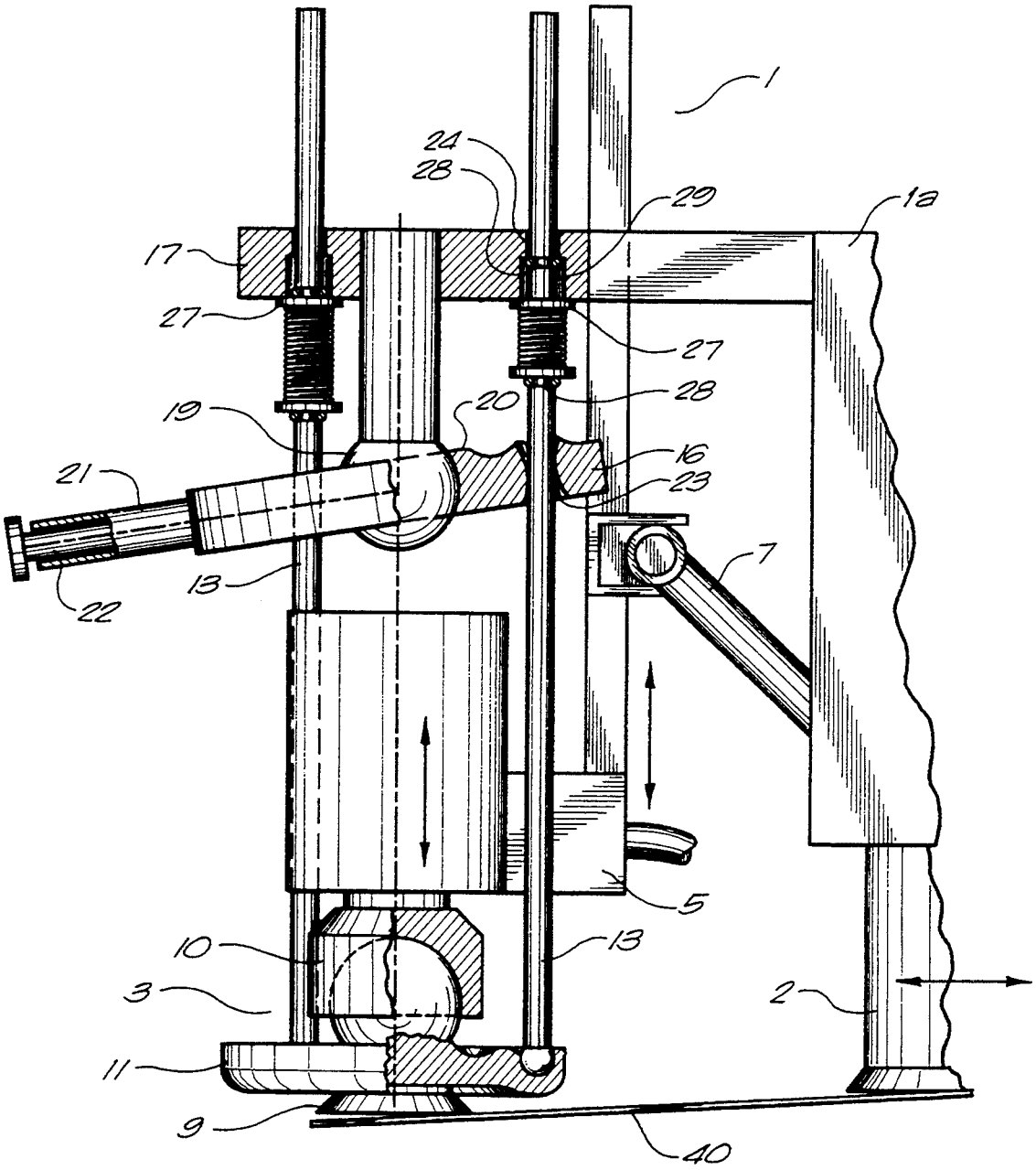
FIG. 3 shows the apparatus of the present invention in its second sheet-releasing position.

In FIG. 3, there is illustrated the present invention in its sheet-releasing position. It can be seen that a sheet 40 is shown as secured to the suction plate 9. In the position illustrated in FIG. 3, suction plate 9 has a generally horizontal profile. This horizontal profile corresponds to the horizontal profile of the drag sucker 2. When the sheet 40 is appropriately lifted by the mechanism of apparatus 1, the sheet 40 is in a position so as to be secured to the drag sucker 2. The drag sucker 2 will effectively transfer the sheet 40 in a horizontal direction. The suction provided by sucker 9 is released so that the sheet 40 may be appropriately moved. Since the sucker 9 is in a relatively horizontal position, the sheet 40 will tend to extend outwardly in a horizontal position. By placing the sheet 40 in a horizontal position, the sheet 40 will be sufficiently lifted so as to be in proximity to the drag sucker 2. In contrast, in conventional systems, an inclination of the separating sucker 9 could tend to cause the sheet 40 to be inclined so as to be distal the drag sucker 2. As a result, in conventional systems, the sheet 40 would not come into such close proximity to the drag sucker 2 so as to allow for engagement. The present invention, by its continuous readjustment of the separating sucker, ensures the horizontal profile during the transfer to the drag sucker 2.

The advantages of the present invention are achieved by the fact that the separating sucker 9 is automatically positioned in a horizontal profile by virtue of the abutment of the upper spring plates 27 with the resetting plate 17. In contrast to the angled configuration of FIG. 2, the movement of the setting bars 13 will eventually cause these spring plates 27 to come into abutment with the surface of resetting member 17. In effect, a time delay will occur between the encountering of each of the setting bars 13 with the resetting member 17. The contact between the spring plates 27 and the resetting member 17 will cause a corresponding alignment of the carrier plate 11 and the associated separating sucker 9. As can be seen, the ramp disk 16 will remain stationary, in its inclined position, during the upward movement of each of the setting bars 13.

In general, the plate carrier 11 is set precisely parallel to the surface formed by the top side of the ramp disk 16. At the end of the upward stroke, this setting is cancelled by the engagement of the upper spring plates, forming upper abutment elements, on the horizontal resetting plate 17. The lower clamping rings 28 may plunge into the associated opening 23 in the ramp disk 16. In this arrangement, the spring plate 26 is retained in engagement with the top face of the ramp disk 16. Because of the elasticity of the compression spring 25, it is possible to compensate for differences in the outward motion of the piston-and-cylinder unit 8 through the stepwise action of the lifting device for the stack. This also serves to dampen jerks upon engagement. A further cushioning effect is provided for the elastic impact of the upper spring plate on the resetting member 17. The resetting member 17 is provided with receiving chambers 29 associated with the guide holes 24. These receiving chambers have a widened area into which the upper clamping rings 28 may plunge. The associated spring plates 27 enter into abutment with the surface of the resetting plate 17 adjacent to the edge of the receiving chambers 29. The compression springs 25, of each of the resetting bars 13, are tensioned by the same amount so that resilient equilibrium is achieved. This leads to the desired horizontal alignment of the associated plate carrier 11.

Figure 4:
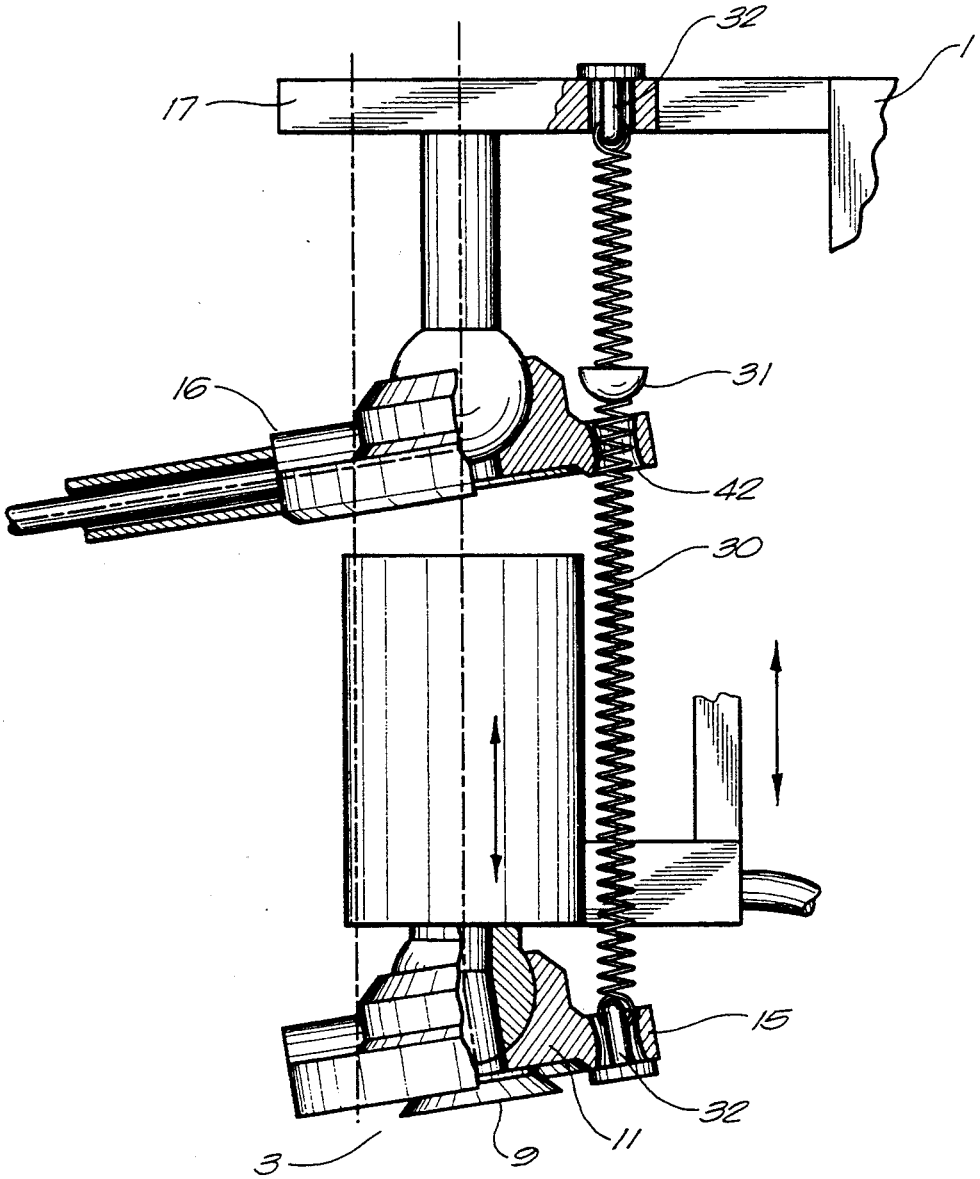
FIG. 4 shows an alternative embodiment of the present invention showing, in particular, the separating suckers operated by tension springs, in a view corresponding to that of FIG. 1.

The basic structure of the embodiment illustrated in FIG. 4 is generally identical to that of the arrangement illustrate in FIGS. 1–3. However, the differences between the embodiments of the present invention are described hereinafter. In this description, like parts are denoted by like reference characters for the purposes of simplicity and clarity.

In FIG. 4, a resilient setting member 30 is placed between the plate carrier 11 and the resetting plate 17. The setting members 30 each bear an abutment element 31. Abutment element 31 is positioned over the ramp disk 16. In general, the setting member 30 extends through opening 42 of the ramp disk 16. The abutment element 31 is positioned in proximity to the opening 42. The opening 42 has a configuration similar to the opening 23 of the previous embodiment of the present invention. The tension springs 30 are pivotally connected by eyes 32 at their lower end with flange 15 of the plate carrier 11. Tension springs 30 also have their upper ends pivotally connected by means of eyes 32 on the resetting plate 17. The tension springs extend through openings 42 in the ramp disk 16 such that the abutment element 31 comes into engagement with the ramp disk 16 when the tension spring 30 is extended. The tension springs 30 are pretensioned such tensioning remains when the tension spring 30 is at its minimum possible length between eyes.

In the preferred embodiment of FIG. 4, there will be typically three setting members for each plate carrier 11. As long as the tension springs 30 are in equilibrium (e.g. under the same tension), the plate carrier 11 and the associated suction plate 9 will be in parallel relationship to the resetting plate 17. The suction plate will have a generally horizontal profile. In such a position, the suction plate 9 will be in a proper position for releasing a sheet to the drag suckers 2.

On the other hand, when one of the abutment elements 31 is in engagement with the ramp disk 16, then the plate carrier 11 will not be in horizontal alignment. In the event of an inclination of the ramp disk 16, the abutment elements 31 will come into engagement with the opening 42 of the ramp disk 16 in a consecutive manner. As a result, there will be different resilient forces between the tension springs 30. This will lead to a pivotting motion of the plate carrier 11 so as to restore equilibrium between the springs. In this arrangement, the plate carrier 11 will be approximately parallel to the ramp disk 16. Such an alignment will occur when the stack 4 is inclined. In this configuration, the suction plate 9 will be in a proper position to properly engage the uppermost sheet on the stack 4.

The plate carrier 11 may be produced by injection molding or injection casting. In order to increase the speed of production, it is possible to use the same parts for the manufacture of the ramp disk 16.

Although the preferred working embodiments of the present invention have been described herein, this is not intended to limit the invention. One with ordinary skill in the art will have a large number of opportunities available in order to adapt the general principle of the present invention to the circumstances of an individual case. Thus, it is possible, for instance, to replace the ball joints by single-axis hinge Joints if pivotting about one axis is sufficient. In such a case, the number of the setting members needed would be reduced to two setting members. Each of these setting members would preferably be arranged opposite each other in relation to the pivot axis. It would also be possible to achieve the desired degree of relative motion and the use of elastic material in place of the springs. The foregoing disclosure should only be limited by the following claims and their legal equivalents.

I claim:

1. An apparatus for lifting a sheet from a stack of sheets comprising:

a suction head frame;

suction plate means for engaging the sheet;

lifting means connected to said suction plate means so as to move said suction plate means in a vertical direction, said lifting means for moving said suction plate means between a first sheet-engaging position and a second sheet-releasing position, said suction plate means pivotally connected to said lifting means so as to align parallel to a surface of the stack;

a setting member extending upwardly from said suction plate means to said suction head frame, said suction plate means pivotally connected to said setting member, said setting member linearly movable relative to said suction head frame; and a ramp member connected to said frame and positioned along a length of said setting member, said ramp member in cooperative relationship with said setting member, said setting member for causing said suction plate means to be positioned in parallel relation to said ramp member when said suction plate means is in said first position, said ramp member being stationary during a movement of said suction plate means between said first and second positions, said suction plate means comprising:

a plate carrier;

a suction plate affixed to a surface of said plate carrier, said plate carrier pivotally connected to said setting member, said suction plate having a surface for engaging the sheet; and a ball fitting attached to a surface of said plate carrier opposite said suction plate, said ball fitting being in a pivotal relationship with respect to said lifting means.

2. The apparatus of claim 1, said frame having a surface for receiving an end of said setting member, said setting member extending vertically upwardly from said suction plate means.

3. The apparatus of claim 2, said ramp member being a ramp disk centered on an axis of the suction plate means, said disk being spaced from said frame by a pin which extends from said frame, said pin having a bearing head, said bearing head supporting said ramp member.

4. The apparatus of claim 1, said lifting means comprising:

a piston-and-cylinder unit including a piston, said piston having a receptacle formed therein, said receptacle for receiving said ball fitting.

5. The apparatus of claim 4, said lifting means further comprising:

a guide bar slidably supported by said frame, said piston-and-cylinder unit connected to said guide bar, said guide bar movable in a vertical direction.

6. The apparatus of claim 1, said setting member having an abutment member affixed thereto, said abutment member for abutting said ramp member when said suction plate means is in said first position.

7. The apparatus of claim 6, said abutment member comprising:

a spring plate extending around said setting member in a relatively fixed position; and a spring extending between a reset member and said spring plate.

8. The apparatus of claim 1, said setting member comprising:

a plurality of setting bars connected to different locations on said suction plate means, said plurality of setting bars linearly movable relative to said suction head frame.

9. The apparatus of claim 1, said setting member comprising a plurality of setting bars, each of said setting bars connected to said plate carrier, each of said setting bars having a pretensioned compressive spring mounted thereon.

10. The apparatus of claim 1, said frame comprising:

a resetting member arranged stationarily in a horizontal position, said suction plate means positioned parallel to said resetting member in said second position.

11. An apparatus for lifting a sheet from a stack of sheets comprising:

a suction head frame;

suction plate means for engaging the sheet;

lifting means connected to said suction plate means so as to move said suction plate means in a vertical direction, said lifting means for moving said suction plate means between a first sheet-engaging position and a second sheet-releasing position, said suction plate means pivotally connected to said lifting means so as to align parallel to a surface of the stack;

a setting member extending upwardly from said suction plate means to said suction head frame, said suction plate means pivotally connected to said setting member, said setting member linearly movable relative to said suction head frame; and a ramp member connected to said frame and positioned along a length of said setting member, said ramp member in cooperative relationship with said setting member, said setting member for causing said suction plate means to be positioned in parallel relation to said ramp member when said suction plate means is in said first position, said ramp member being stationary during a movement of said suction plate means between said first and second positions, said setting member having an abutment member affixed thereto, said abutment member for abutting said ramp member when said suction plate means is in said first position, said ramp member articulated about a pin, said pin supported in a fixed position with respect to said frame, said ramp member having an opening extending therethrough, said setting member extending through said opening.

12. The apparatus of claim 11, said abutment member affixed to said setting member on a side of said ramp member opposite said suction plate means, said frame defining a horizontal reset plate, said setting member extending through a guide hole in said reset plate.

13. The apparatus of claim 12, said abutment member movable with said setting member so as to abut said reset plate when said suction plate means is in said second position, said suction plate means being parallel to said reset plate when in said second position.

14. The apparatus of claim 11, said ramp member positioned between said suction plate means and a reset member.

15. The apparatus of claim 11, said opening in said ramp member having widened diameters adjacent opposite surfaces of said ramp member, said opening for enabling said ramp member to rock relative to said setting members.

16. An apparatus for lifting a sheet from a stack of sheets comprising:

a suction head frame;

suction plate means for engaging the sheet;

lifting means connected to said suction plate means so as to move said suction plate means in a vertical direction, said lifting means for moving said suction plate means between a first sheet-engaging position and a second sheet-releasing position, said suction plate means pivotally connected to said lifting means so as to align parallel to a surface of the stack;

a setting member extending upwardly from said suction plate means to said suction head frame, said suction plate means pivotally connected to said setting member, said setting member linearly movable relative to said suction head frame; and a ramp member connected to said frame and positioned along a length of said setting member, said ramp member in cooperative relationship with said setting member, said setting member for causing said suction plate means to be positioned in parallel relation to said ramp member when said suction plate means is in said first position, said ramp member being stationary during a movement of said suction plate means between said first and second positions, said ramp member having a releasable locking mechanism affixed thereto, said locking mechanism for fixing said ramp member in a position.

17. The apparatus of claim 16, said releasable locking mechanism comprising:

a setting arm having a clamping member extending therethrough, said clamping member acting on a bearing member supporting said ramp member.

* * * * *